US006928947B1

(12) United States Patent
Clapham

(10) Patent No.: US 6,928,947 B1
(45) Date of Patent: Aug. 16, 2005

(54) SUBMERSIBLE VEHICLE

(75) Inventor: Paul David Clapham, Northallerton (GB)

(73) Assignee: Coflexip, SA, (FR)

( * ) Notice: Subject to any disclaimer, the term of this patent is extended or adjusted under 35 U.S.C. 154(b) by 0 days.

(21) Appl. No.: 10/148,361

(22) PCT Filed: Nov. 24, 2000

(86) PCT No.: PCT/GB00/04470

§ 371 (c)(1),
(2), (4) Date: Jul. 9, 2002

(87) PCT Pub. No.: WO01/38167

PCT Pub. Date: May 31, 2001

(30) Foreign Application Priority Data

Nov. 24, 1999 (GB) ..... 9927624

(51) Int. Cl.[7] ..... B63G 8/00

(52) U.S. Cl. ..... 114/312; 114/313; 114/330

(58) Field of Search ..... 114/312, 313, 330, 114/50–53; 294/66.1, 66.2, 81.3

(56) References Cited

U.S. PATENT DOCUMENTS

| | | | | | |
|---|---|---|---|---|---|
| 1,373,574 | A | * | 4/1921 | Swaney | 114/51 |
| 1,568,716 | A | * | 1/1926 | Boulton | 294/66.1 |
| 2,598,075 | A | * | 5/1952 | Seidel | 294/67.3 |
| 3,486,475 | A | * | 12/1969 | Popoli | 114/52 |
| 3,635,183 | A | * | 1/1972 | Keatinge | 114/330 |
| 4,597,602 | A | * | 7/1986 | McGriff | 294/81.3 |
| 4,615,292 | A | | 10/1986 | Laukien | |
| 4,973,094 | A | * | 11/1990 | Tana et al. | 294/81.21 |

FOREIGN PATENT DOCUMENTS

| | | | |
|---|---|---|---|
| DE | 2929439 | 2/1981 | |
| JP | 2-300092 | * 12/1990 | 294/66.1 |

* cited by examiner

*Primary Examiner*—Sherman Basinger
(74) *Attorney, Agent, or Firm*—Ostrolenk, Faber, Gerb & Soffen, LLP

(57) ABSTRACT

A remotely controlled submersible vehicle comprises a fore section and an aft section. In use, they are held apart from each other, such as by telescopic arms, in order to define a gap within which a payload is received. This keeps the payload near the center of the vehicle, improving the balance of the vehicle and minimizing any threat of disruption to the wash path of thrusters.

31 Claims, 5 Drawing Sheets

SUBMERSIBLE VEHICLE

This is a U.S. national stage of International Application PCT/GB00/04470, filed Nov. 24, 2000. Priority is claimed on that application and on the following application: Country: Great Britain, Application No. 9927624.8, filed Nov. 24, 1999.

BACKGROUND OF THE INVENTION

The present invention relates to submersible vehicles and in particular, to remotely controlled submersible vehicles (referred to hereafter as RCSVs). Such vehicles are also commonly referred to as remotely operated vehicles (ROVs).

RCSVs are suspended, in use, from an umbilical cord through which various services are provided, including control signals for controlling the RCSV. RCSVs may also be used to transport payloads from one location to another. Conventional RCSVs, are designed to carry tooling packages attached around the periphery of the RCSV, particularly the fore, aft, side or underneath faces of the RCSV. This can result in poor performance and poor controllability of the RCSV as discussed below. RCSVs are commonly used to perform tasks at subsea oil installations such as wellheads and manifolds. These tasks may require specialist tools or equipment. If so, the tools or equipment may be carried on board the RCSV and operated through the control system onboard the RCSV, controlled from the sea surface by means of the umbilical cord.

Typically, RCSVs are propelled by a number of hydraulically or electrically driven thrusters (sometimes called propulsors) attached to the frame of the RCSV, to point in various directions, primarily generally vertically or horizontally. It is desirable to maintain an unimpaired flow path (commonly called the wash path) of sea water into and out of the thruster in order to maximise the motive power provided to the RCSV, and thereby optimise performance. In order to reduce impairment in the wash path by components of the RCSV, it has been proposed to mount thrusters at an angle to the main axis of the RCSV, at or near the corners of the RCSV. However when a tooling package is mounted at a position at the periphery of the RCSV, its presence is likely to impair the wash path of one or more of the thrusters, which can impede the performance and controllability of the RCSV. Alternatively, the size or shape of a payload which can be deployed may be limited in order to avoid impairment of a wash path.

A further problem with previous proposals arises because the effect of the additional weight of the payload attached at a position around the periphery of the RCSV is to move the centre of gravity of the combination away from the position of the centre of gravity of the RCSV alone. However, the position at which lifting gear is attached to the RCSV would normally be chosen to be above or close to the centre of gravity of the RCSV in order to maintain the RCSV substantially horizontal when being lifted and handled during deployment and recovery. The presence of the payload will therefore deflect the RCSV from this horizontal attitude, resulting in increased lifting and handling problems during deployment and recovery.

SUMMARY OF THE INVENTION

In accordance with the invention, there is provided a remotely controlled submersible vehicle comprising two sections which, in use, are held apart from each other to define a gap within which a payload is received (and which, in the absence of a payload, is operable as a "standard" RCSV).

By virtue of the invention, the payload is carried near to the centre of the RCSV rather than its periphery. In this way, the wash path of the thrusters is likely to be un-impaired, enhancing vehicle motive power and control. Furthermore, larger and heavier payloads can be deployed without unacceptable impairment of wash paths or attitude.

Preferably, the separation of two sections is adjustable, in use, whereby to accommodate a range of payload sizes. The vehicle may comprise connection members which, in use connect together the two sections. The connection members may be adjustable to change the width of the gap. Alternatively, the connection members may be adjustably attached to the two sections to allow the width of the gap to be changed.

Alternatively, each section may comprise means operable to connect the section to the payload, whereby in use, the sections are connected together solely by means of a payload. The connection means may be operable to connect the sections to each other, in the event that the vehicle is not required to carry a payload.

The vehicle may further comprise a lifting connection for attachment to a lifting device for lifting the vehicle, the lifting connection being provided on the vehicle at a position which is adjustable, to allow the position of the lifting connection to be changed relative to the combined centre of gravity of the vehicle and any payload carried by the vehicle.

Preferably the lifting connection is provided by connector means located on each side of a lifting means the connector means being connectable to a series of apertures incrementally spaced along the vehicle in the fore or aft directions.

Alternatively, the lifting connection is provided by a rail along which lifting means can run in the fore or aft directions.

Optionally, the lifting connection is provided by a triangular frame the first and second corners of which are connected to the vehicle, the corners of the triangles containing pivot points such that the angles between the sides of the triangular frame are alterable and wherein at the length of at least one of the sides of the triangular frame is adjustable such that on adjustment thereof, the position of the third corner is alterable with respect to the fore and aft ends of the vehicle.

The vehicle may be divided substantially transversely, whereby the sections are located, in use fore and aft of the gap. Alternatively, the vehicle may be divided substantially longitudinally, whereby the sections are located, in use, to either side of the gap.

The vehicle is preferably divided at or near the centre of gravity of the unloaded vehicle, whereby the centre of gravity of a payload introduced into the gap is at or close to the centre of gravity of the vehicle.

Each section preferably carries equipment which contributes to the manoeuvrability and/or buoyancy of the vehicle.

BRIEF DESCRIPTION OF THE DRAWINGS

Examples of the present invention will now be described in more detail, by way of example only, and with reference to the accompanying drawings, in which.

DETAILED DESCRIPTION OF THE PREFERRED EMBODIMENTS

Figure 1:
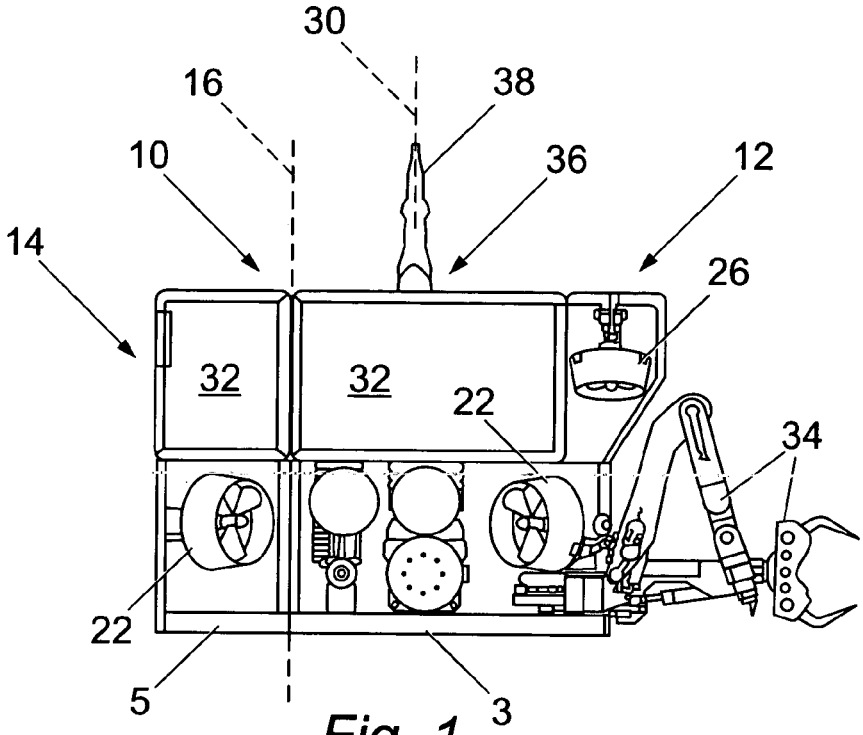
FIG. 1 is a side elevation of an RCSV in accordance with the invention, without payload.

FIG. 1 illustrates a remotely controlled submersible vehicle (RCSV) 10 which comprises two sections, namely a fore section 12 and an aft section 14. Each of the sections are supported by a frame 3 and 5 respectively, collectively referred to as the RCSV frame 3,5. These meet at a plane illustrated in FIG. 1 by a broken line 16. In use, they are held apart from each other in a manner to be described, in order to define a gap 18 (FIG. 3) within which a payload 20 is received.

Figure 2:
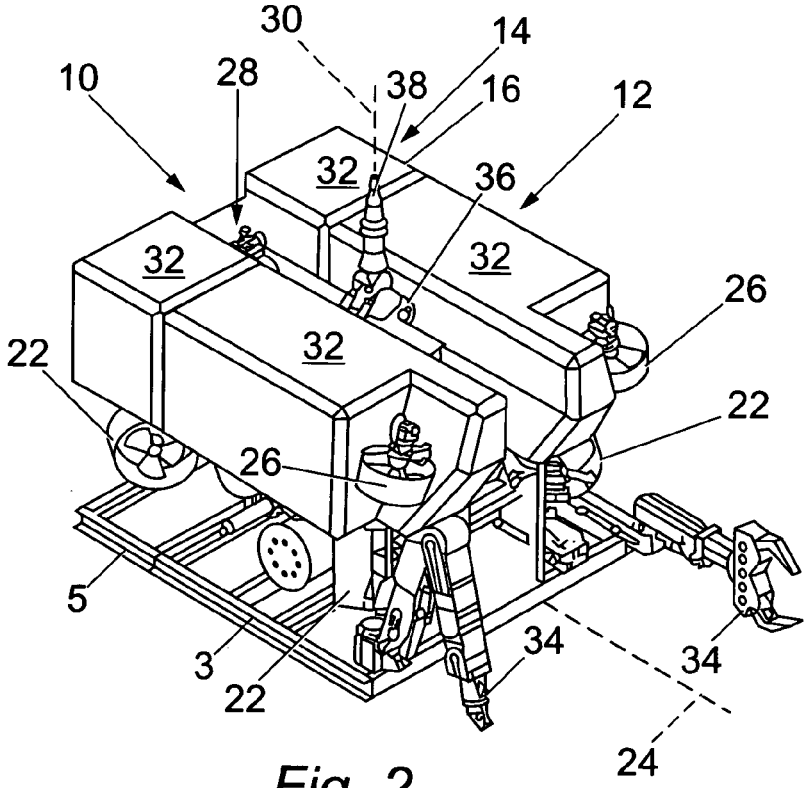
FIG. 2 is a perspective view of the RCSV of FIG. 1.

Some operations of the RCSV may not require the RCSV to carry a payload. It is convenient to describe the configuration of the vehicle for those operations, before discussing the arrangements for carrying a payload. For operations without a payload, the RCSV 10 will be configured as shown in FIGS. 1 and 2, with the fore and aft sections 12, 14 abutting at 16, there being no gap between them. They are attached to each other by attachment arrangements which will be described further in relation to FIGS. 3 and 4. When configured in this way, the RCSV 10 will resemble conventional RCSVs.

It can be seen from FIGS. 1 and 2 that the RCSV, when configured without a payload, has a generally parallelepiped form. Four horizontal thrusters 22 are provided, one in the vicinity of each corner of the parallelepiped and arranged to thrust in a generally horizontal plane, typically at an angle of approximately 45° to the fore/aft axis 24 of the vehicle (FIG. 2). Downward thrusters 26, 28 are also provided. The thrusters 26 are provided at the fore corners of the fore section 12. The thruster 28 is shown partially obscured in FIG. 2, centrally located across the aft face of the aft section 14. The thrusters 26, 28 are typically angled down at a slight angle (approximately 15°) from the vertical axis 30 (FIG. 2).

It is to be understood that all references to vertical, horizontal, fore, aft and other similar terms are intended to refer to the preferred orientation of the vehicle 10 during use, as shown in the figures, but are not intended to imply any limitation on the scope of the invention.

Buoyancy modules 32 are provided around the top of the vehicle 10 on the fore section 12 and on the aft section 14. The modules 32 are sufficient to make the vehicle 10 approximately neutral in buoyancy in water, when no payload is present.

It can be understood from the above description that the sections 12, 14 both carry equipment (thrusters and buoyancy modules) which contribute to the manoeuvrability and buoyancy of the vehicle.

Robotic manipulator arms 34 may be provided at the front of the fore section 12 for use in a manner which is conventional in itself.

A lifting connection 36 is provided at the top of the vehicle 10. The connection 36 is used for lifting and lowering the vehicle 10 during deployment and retrieval, and incorporates connections to an umbilical cord 38 providing services such as power, data communication, control etc, during use. The lifting connection 36 will be described in more detail below.

Figure 3:
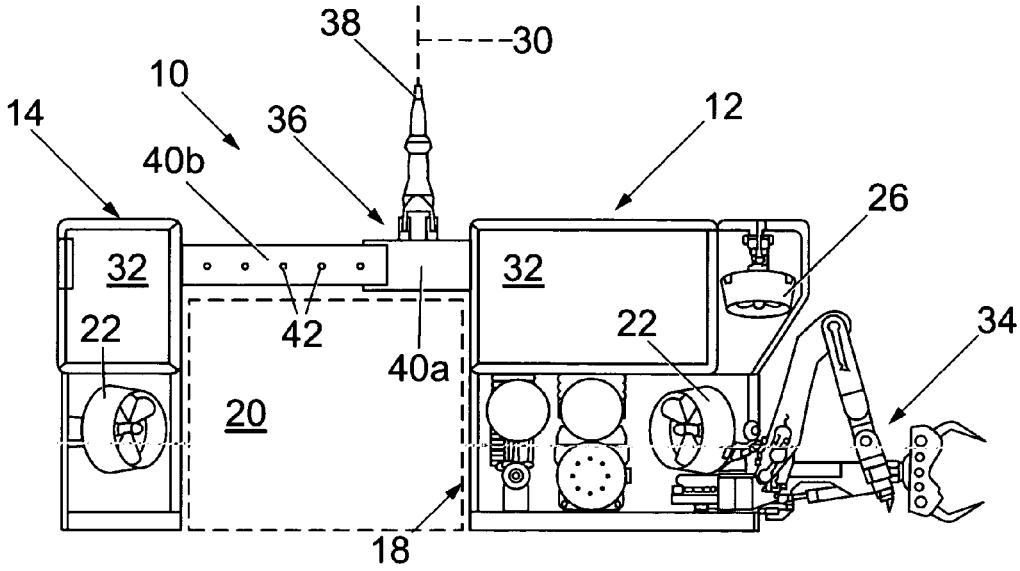
FIG. 3 corresponds with FIG. 1, and illustrates the manner in which a payload is accommodated by the vehicle.
Figure 4:
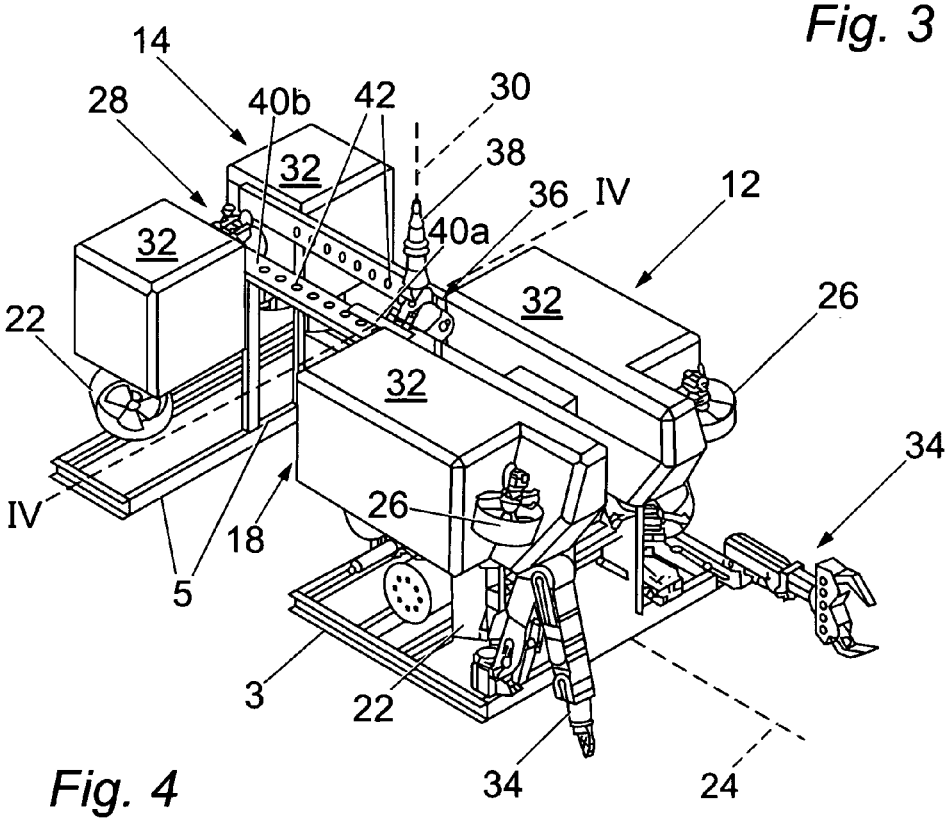
FIG. 4 is a perspective view of the RCSV adapted for accommodating a payload (not shown)

The sections 12, 14 are discrete units, as has been described, so that when a payload is to be carried by the vehicle 10, the sections 12, 14 may be moved apart to a position such as that illustrated in FIG. 3. In that position, the sections 12, 14 define a gap 18 between themselves, within which the payload 20 can be accommodated. The separation of the sections 12, 14 is achieved, in this example, by means of telescopic arms 40A, 40B attached, respectively, to the fore and aft sections 12, 14. The arms 40A, 40B co-operate to extend or collapse in telescopic manner as the sections 12, 14 move apart or together. Means may be provided, such as a row of holes 42 formed along one of the arms 40A, 40B, to allow the relative position of the arms 40A, 40B to be locked by insertion of a bolt or other locking arrangement. This would allow the width of the gap 18 to be selected from a range of gap widths available, so that the gap width can be chosen in accordance with the size of the payload 20. Other locking arrangements may be envisaged to provide continuously variable gap widths. In a further alternative, the vehicle 10 may have a single configuration in which the gap 18 is open, in addition to the configuration in which the gap is closed, but it is envisaged that the vehicle 10 will be more versatile if some degree of adjustment of the gap width is possible.

In the example described above arms 40A, 40B are fixed to the sections 12, 14 and adjustable relative to each other. In an alternative, an arm of fixed length may be adjustably attached to one or both of the sections 12, 14.

The payload 20 is held within the gap 18 by means of an attachment arrangement. Suitably, the payload is attached to the RCSV by attaching the frame of the payload to the frame of the RCSV in one of the following ways.

1. Bolting of the frame of the payload 20 to the RCSV frame 3,5 by manual intervention on the deck of a vessel;

2. Attachment of the frame of the payload to the RCSV frame 3,5 at discreet points using quick connection pins, by manual intervention on deck.

3. Remote connection of the frame of the payload to the RCSV frame 3,5 using hydraulically or electrically actuated pins or other latching methods. This operation may therefore be carried out subsea, using the actuators powered by and controlled from the RCSV. payload or other remote intervention machine.

During connection to the RCSV, the frame of the payload may be designed to add to the stiffness of the combined vehicle framework, or the RCSV extended frame may be sufficiently strong to carry all the applied load by itself.

The attachment arrangement can also be used to attach together the fore and aft sections 12, 14 in the event that a payload gap is not required.

The arrangements relating to the lifting connection 36 can now be described in more detail. The connection 36 can be seen in FIG. 1 to be approximately central of the vehicle 10 in the fore and aft (longitudinal) direction, and can be seen from FIG. 2 to be approximately mid-way across the vehicle 10, in the transverse direction. The longitudinal position of the connection 36 is chosen to be above the centre of gravity of the vehicle 1 when in the configuration of FIG. 1, or close to that position, so that when suspended by the connection 36, the vehicle 10 will tend to hang with its longitudinal axis approximately horizontal. The weight of the vehicle 10 and its components can be distributed from side to side of the vehicle 10 in order to maintain balance in the transverse direction.

It will be readily apparent from comparison of FIGS. 1 and 3 that when the gap 18 is opened, and a payload is inserted, the combined centre of gravity of the payload 20 and vehicle 10 is unlikely to be at the same position as the centre of gravity of the closed vehicle of FIG. 1. In particular, the centre of gravity is likely to have moved further aft relative to the fore section 12, but appropriate design of the payload 20 is likely to allow the centre of gravity to remain at, or close to the central longitudinal axis of the vehicle 10.

In order to accommodate the rearward movement of the centre of gravity, the connection 36 is made adjustable in the fore and aft direction.

Figure 5A:
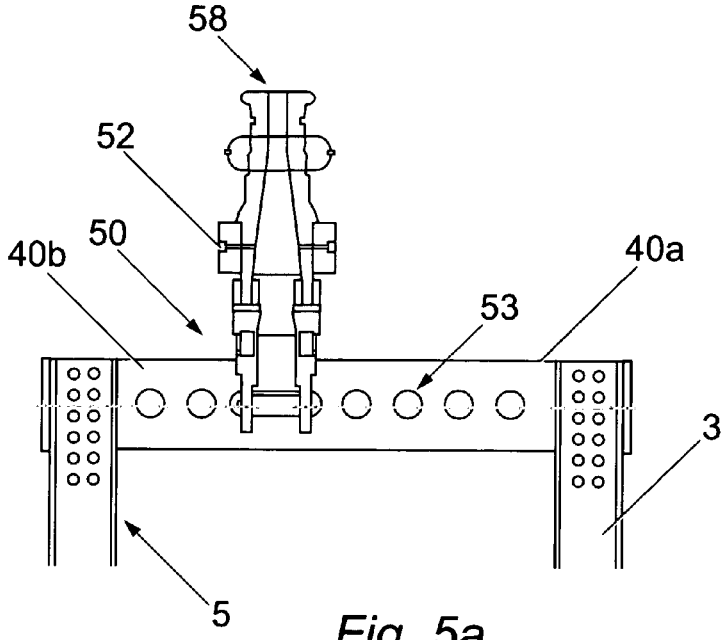
FIG. 5*a* is a view in the direction defined by the line IV—IV in FIG. 4, illustrating a first embodiment of a lifting connection in which the location of the lifting connection may be adjusted.
Figure 5B:
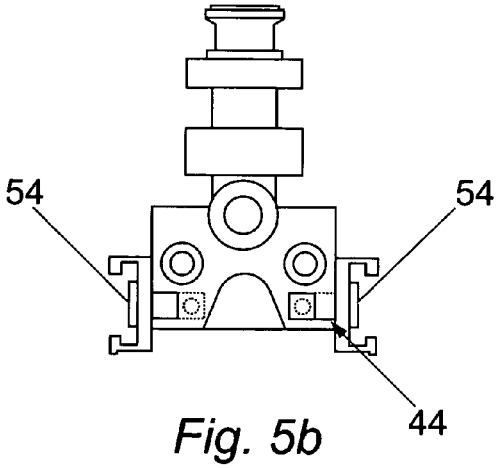
FIG. 5*b* is a side view of the first embodiment and FIG. 5*c* is a perspective view of the first embodiment.
Figure 5C:
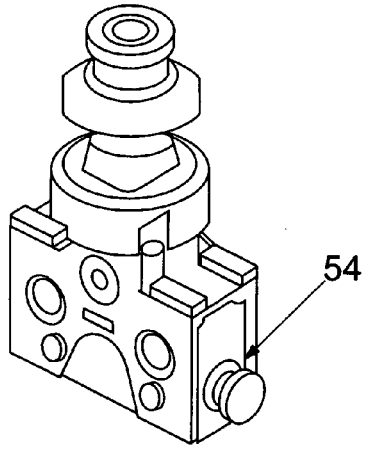

FIGS. 5*a,* 5*b,* and 5*c* show a first embodiment of a lifting connection 50 which can be moved in the fore and aft direction. The lifting connection 50 consists of a body 52 which has a pair of pins 54 (FIGS. 5*b* and 5*c*) which extend from opposite sides of the body 52 so as to be connectable with a series of apertures 56 located along the length of the telescopic arms 40*a* and 40*b* in the fore/aft direction. In use, the lifting connection can be positioned at various incrementally spaced positions along the length of the arms 40*a,* 40*b* by connecting the pins 54 to the apertures 56. The position of the lifting connection is set manually on the deck of a vessel before the RCSV is launched.

Figure 6:
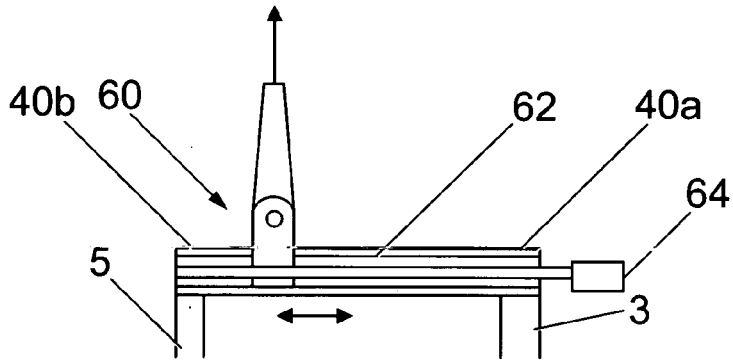
FIG. 6 is a view in the direction defined by the line IV—IV in FIG. 4. illustrating a second embodiment of a lifting connection in which the location of the lifting connection may be adjusted.
Figure 7:
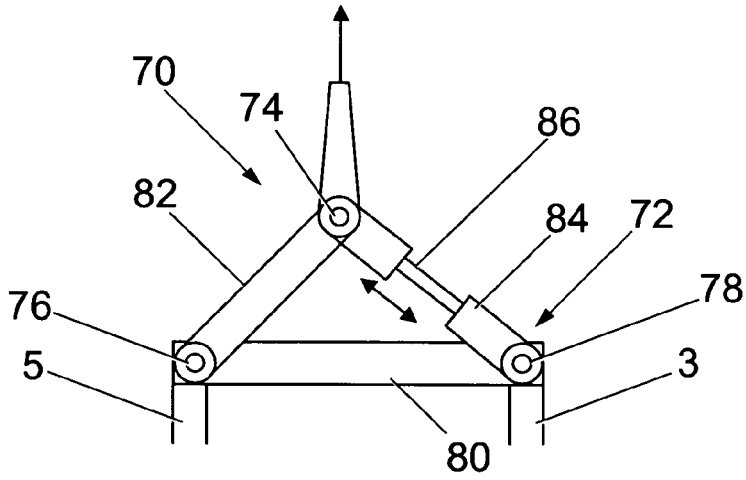
FIG. 7 is a view in the direction defined by the line IV—IV in FIG. 4. illustrating a third embodiment of a lift connection in which the location of the lifting connection may be adjusted.

FIG. 6 and FIG. 7 provide lifting connections whose fore and aft positions can be changed remotely, usually from the vessel from which the RCSV has been deployed. Alternatively, adjustment of the position of the lifting connections may be carried out in the sub-sea environment from the RCSV, the payload or other remote intervention machine.

FIG. 6 shows a second embodiment of a lifting connection 60 that can be moved in the fore and aft directions. A rail which forms a slideway 62 positioned on the arms 40*a,* 40*b* at each side of the frame. The slideways 62 are provided with actuation means 64 that are operable electrically or hydraulically. The lifting connection 62 can be moved linearly in a continuous manner along the slideway 62 between the fore and aft ends of the rotary frame.

FIG. 7 shows a third embodiment of a lifting connection 70 that can be moved in the fore and aft directions. In this example, the lifting connection is shaped as a structural triangle 72. Each of the corners of the triangle 74, 76 and 78 are provided with pivots which allow the angles between the sides 80, 82 and 84 to be altered in response to the linear movement of the adjustable link 86. It will be appreciated that as the adjustable link 86 is extended linearly, the connection point for the umbilical will move towards frame member 5. As the adjustable link 86 is retracted, the connection point for the umbilical will move towards frame member 5

Clearly, the lifting connections 36, 55, 60 and 70 have some freedom to be adjusted in the fore and aft direction, to allow the position of the lifting connection 36 to be changed relative to the combined centre of gravity of the vehicle 10 and payload 20. It is preferred to provide the lifting connection with sufficient range of adjustment to be moved over the combined centre of gravity for any payload with which the vehicle 10 is envisaged to be used. However, even if it is not possible to move the connection 36 to be directly over the combined centre of gravity, it is advantageous to move the connection 36 as near to that position as is possible, in order that the vehicle and load will hang closer to the horizontal that would otherwise be the case. It is advantageous if the sections 12, 14 meet at or close to the centre of gravity of the closed vehicle (FIG. 1), so that the centre of gravity of the payload 20 will then be at or close to the centre of gravity of the vehicle 10, thus minimising the adjustment required for the connection 36.

It will thus be apparent that the vehicle 10 allows a range of tooling package sizes, weights and weight distributions to be accommodated while maintaining the ability to provide good or adequate balance and attitude for the combination of vehicle and payload. In addition to maintaining the attitude of the vehicle, the location of the payload 20 near the centre of the vehicle 10 keeps the payload 20 away from the wash path of the thrusters 22, 26, 28 so that they can operate substantially unimpaired by the presence of the payload 20, allowing improved vehicle motive power and control to be achieved and thus allowing the upper limit on payload size and weight to be higher than would be possible if thruster wash paths were being impaired.

Figure 8:
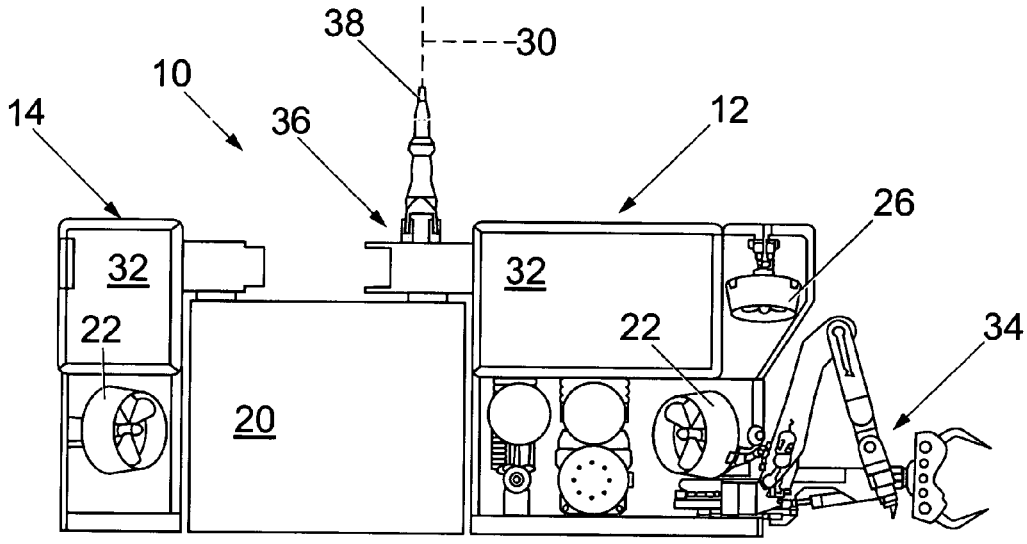
FIG. 8 is a side elevation of a further embodiment of the invention with a payload in position.

Another embodiment of the invention is shown in FIG. 8. In this embodiment, the sections 12, 14 are connected directly to the payload 20 so that the sections 12, 14 are connected together solely by the payload 20.

It will be understood that any of a variety of different types of payload carried by a vehicle in accordance with the invention, including but not limited to one or more tool and/or instrumentation packages etc, adapting the vehicle to perform any of a variety of different tasks. It will further be understood that the payload need not be contained entirely within the gap between the vehicle sections. For example, a payload may include a power and control package mounted in the gap and connected to operators, manipulators, sensors etc. located elsewhere on the vehicle (e.g. at the front thereof). The vehicle and/or payload may also be remotely controllable such that the payload may be deployed or unloaded from the vehicle. The vehicle may further be configured such that the gap can be opened and closed under remote control; e.g. so that a payload may be deployed/unloaded from the vehicle and the gap closed thereafter.

It will further be understood that the invention does not preclude the possibility of conventional types of payload being carried by the vehicle by conventional means, whether or not a payload is mounted in the gap between the vehicle sections. For example, the vehicle may be configured to carry a substantially conventional tool skid or the like on its underside.

Many variations and modifications can be made to the apparatus described above, without departing from the scope of the invention. In particular, many different sizes, relative sizes and arrangements of the vehicle 10 and its component parts could be envisaged. The vehicle 10 has been described as dividing at a transverse plane but could be divided at a longitudinal plane to form port and starboard sections which move apart sideways to receive a payload.

What is claimed is:

1. An independently mobile submersible vehicle comprising:

two vehicle sections; at least one independently operable, remotely controlled thruster on at least one of the two sections for providing said submersible vehicle with said independent mobility, at least one of said sections comprising a robot arm which is operable for performing a task at a subsea installation;

each of said vehicle sections having a respective connection member, said connection members being operable for joining said vehicle sections to each other along a longitudinal direction;

said vehicle sections defining respective cross-sectional shapes, defined transversely to said longitudinal direction, the respective cross-sectional shapes of said two vehicle sections being substantially the same so as to form a compact vehicle when connected together;

said vehicle sections defining a gap therebetween, for accommodating a payload within said gap, said payload within said gap being disposed away from a wash path of said thruster.

2. A vehicle according to claim 1, wherein the gap between the two sections is adjustable, in use, whereby to accommodate a range of payload sizes.

3. A vehicle according to claim 2, wherein the connection members are adjustable to change the width of the gap.

4. A vehicle according to claim 2, wherein the connection members are adjustably attached to the two sections to allow the width of the gap to be changed.

5. A vehicle according to claim 1, wherein each section comprises a respective connection member operable to connect the section to a payload, whereby in use, the sections are connected together solely by a payload.

6. A vehicle according to claim 5, wherein the connection members are operable to connect the sections to each other, in the event that the vehicle is not required to carry a payload.

7. A vehicle according to claim 1, further comprising a lifting connection for attachment to a lifting device for lifting the vehicle, the lifting connection being provided on the vehicle at a position which is adjustable, to allow the position of the lifting connection to be changed relative to the combined center of gravity of the vehicle and any payload carried by the vehicle.

8. A vehicle according to claim 7, the lifting connection being provided by a connector located on each side of the lifting device, the connector being connectable to a series of apertures incrementally spaced along the vehicle in the fore or aft directions.

9. A vehicle according to claim 8, comprising a respective independently operable thruster on each of the two sections for providing said submersible vehicle with said independent mobility.

10. A vehicle according to claim 7, the lifting connection being provided by a rail along which the lifting device can run in the fore or aft directions.

11. A vehicle according to claim 10, comprising a respective independently operable thruster on each of the two sections for providing said submersible vehicle with said independent mobility.

12. A vehicle according to claim 7, the lifting connection being provided by a triangular frame the first and second corners of which are connected to the vehicle, the corners of the triangles containing pivot points such that the angles between the sides of the triangular frame are alterable and wherein at the length of at least one of the sides of the triangular frame is adjustable such that on adjustment thereof, the position of the third corner is alterable with respect to the fore and aft ends of the vehicle.

13. A vehicle according to claim 12, comprising a respective independently operable thruster on each of the two sections for providing said submersible vehicle with said independent mobility.

14. A vehicle according to claim 7, wherein said lifting connection is provided on a connection member which connects the two sections of the vehicle.

15. A vehicle according to claim 14, wherein said connection member is a telescopic arm.

16. A vehicle according to claim 15, wherein said lifting connection comprises a hole in said telescopic arm.

17. A vehicle according to claim 14, wherein said lifting connection comprises a hole in said connection member.

18. A vehicle according to claim 7, comprising a respective independently operable thruster on each of the two sections for providing said submersible vehicle with said independent mobility.

19. A vehicle according to claim 7, wherein said position of said lifting connection on the vehicle is adjustable remotely.

20. A vehicle according to claim 1, wherein the vehicle is divided substantially transversely, whereby the sections are located, in use, fore and aft of the gap.

21. A vehicle according to claim 1, wherein the vehicle is divided substantially longitudinally, whereby the sections are located in use, to either side of the gap.

22. A vehicle according to claim 1, wherein the vehicle is divided at or near the center of gravity of the unloaded vehicle, whereby the center of gravity of a payload introduced into the gap is at or close to the center of gravity of the vehicle.

23. A vehicle according to claim 1, wherein each section carries equipment which contributes to the maneuverability and/or buoyancy of the vehicle.

24. A vehicle according to claim 1, wherein said at least one thruster is capable of moving said vehicle both vertically and horizontally.

25. A vehicle according to claim 1, further comprising a payload connected to each of said sections, wherein said payload is contained entirely within said gap, said gap being defined by outer dimensions of said sections.

26. A vehicle according to claim 25, wherein said payload is disposed away from a wash path of said at least one thruster.

27. A vehicle according to claim 25, wherein said payload has a frame which contributes to the strength of the vehicle.

28. A vehicle according to claim 1, further comprising a payload, wherein said payload has a frame which contributes to the strength of the vehicle.

29. A vehicle according to claim 1, wherein said gap is defined such that a payload will be disposed away from a wash path of said at least one thruster.

30. A vehicle according to claim 1, comprising a respective independently operable thruster on each of the two sections for providing said submersible vehicle with said independent mobility.

31. A vehicle according to claim 30, wherein said thrusters are capable of moving said vehicle both vertically and horizontally.

* * * * *